United States Patent [19]

Brandes et al.

[11] Patent Number: 5,064,556

[45] Date of Patent: Nov. 12, 1991

[54] GOLF CLUB CLEANING COMPOSITION AND METHOD

[75] Inventors: Joseph F. Brandes, Tigard; Robert N. Schumann, Wilsonville, both of Oreg.

[73] Assignee: Provision, Inc., Vancouver, Wash.

[21] Appl. No.: 654,769

[22] Filed: Feb. 13, 1991

[51] Int. Cl.[5] ..... C11D 3/08; C11D 7/14; C23G 1/00; A63B 53/12

[52] U.S. Cl. ..... 252/135; 252/173; 252/DIG. 14; 134/2; 273/32 B

[58] Field of Search ..... 134/2; 252/135, 173

[56] References Cited

U.S. PATENT DOCUMENTS

| | | | |
|---|---|---|---|
| 2,481,977 | 5/1945 | Cinamon | 252/135 |
| 2,806,000 | 9/1957 | Streicher | 134/2 |
| 2,903,431 | 9/1959 | Ruff et al. | 252/135 |
| 3,367,798 | 2/1968 | Bremer et al. | 134/2 |
| 3,413,231 | 11/1968 | Kolodny et al. | 252/135 |
| 3,419,501 | 12/1968 | Levy | 252/135 |
| 3,808,051 | 4/1974 | Schoenholz et al. | 134/2 |
| 3,847,663 | 11/1974 | Shumaker | 134/2 |
| 3,928,065 | 12/1975 | Savino | 134/2 |
| 3,961,992 | 6/1976 | Jahnke et al. | 134/2 |
| 4,263,284 | 4/1981 | Schreuder | 252/173 |
| 4,581,153 | 4/1986 | Trabitzsch et al. | 252/173 |
| 4,595,519 | 6/1986 | Takeno et al. | 134/2 |
| 4,675,125 | 6/1987 | Sturwold | 252/173 |
| 4,762,638 | 8/1988 | Dollman et al. | 134/2 |
| 4,806,263 | 2/1989 | Leathers et al. | 134/2 |
| 4,820,450 | 4/1989 | Wile et al. | 252/173 |
| 4,847,004 | 7/1989 | McLeod | 252/173 |

OTHER PUBLICATIONS

McCutcheon's Detergents and Emulsifier, 1970.
Schick Nonionic Surfactants, vol. 2, 1967.

*Primary Examiner*—Paul Lieberman
*Assistant Examiner*—Kevin D. McCarthy
*Attorney, Agent, or Firm*—Chernoff, Vilhauer, McClung & Stenzel

[57] ABSTRACT

A composition is disclosed for cleaning dirt and stains from metalwood golf clubs. The composition is especially effective when applied with a nonwoven nylon pad having an abrasive bonded thereto.

9 Claims, No Drawings

GOLF CLUB CLEANING COMPOSITION AND METHOD

BACKGROUND OF THE INVENTION

Golf club manufacturers have recently marketed golf club "woods" having metal heads (hereinafter referred to as "metalwoods"). Commonly, such metalwoods are made of stainless steel and have a sandblast or beadblast finish. Such a finish creates a flat dull surface having a multiplicity of microscopic-sized craters, making effective cleaning of the surface of the metalwoods a difficult task, although conventional golf clubs can be effectively cleaned with a brush and soap and water, this method is not effective with metalwoods.

SUMMARY OF THE INVENTION

The present invention provides a composition for cleaning the metal heads of golf clubs and is particularly directed to cleaning the rough finish of stainless steel metalwoods. The composition is especially effective in cleaning stains made by glass, mud, clay, Surlyn® (a polymeric composition used for the covers of golf balls) and other rubber and polymer and paint compounds. The cleaning composition will work with virtually any applicator, but it is most effective when applied using nonwoven nylon pads having a composition of phenolic resins and abrasives adhered to the nylon pad, the abrasives comprising a material selected from silicon carbide, aluminum oxide and talc.

It is a primary object of the present invention to provide a composition for effectively clearing stainless steel golf club heads having a sandblast finish.

It is a further object of the present invention to provide a method for cleaning stainless steel golf club heads using the aforesaid composition with an especially effective applicator.

These objects and other features and advantages of the invention are set forth in the detailed description which follows.

DETAILED DESCRIPTION OF THE INVENTION

According to the present invention there is provided a composition exceptionally effective at removing commonly-encountered stains from the surface of metalwoods. The composition comprises the approximate weight percentages of the following components:

| Component | wt % |
|---|---|
| polysaccharide xanthan gum; | 0.25–5.0 |
| sodium metasilicate; | 0.25–5.0 |
| sodium ethylene diaminetetraacetate; | 0.25–5.0 |
| lower alkyl ester of a linear primary alcohol containing 9–17 carbon atoms; | 0.25–5.0 |
| sulfonated distyryl biphenyl | 0.01–0.1 |
| lower alkyl acid ester of p-hydroxybenzoic acid; | 0.01–0.1 |
| dye; and | 0.001–0.01 |
| balance deionized water. | |

An especially preferred composition is illustrated in the Example herein.

The linear alcohol component of the composition acts as a surfactant which works together with the sodium metasilicate and sodium ethylene diaminetetraacetate components to penetrate through soils and stains to lift them from the surface of the golf club heads. The sulfonated distyryl biphenyl component is an optical brightener to make the surface of the club appear cleaner; an exemplary and especially preferred commercially available form is made by Ciba-Geigy of Greensboro, North Carolina and sold under the name "Tinopal CBS-Extra." The sodium metasilicate component is a corrosion protectant to prolong the quality of the finish of the golf club head and it also chelates any hard water ions present to preclude water spotting of the finish. The p-hydroxybenzoic acid component stabilizes the solution and increases its shelf life.

The cleaning composition may be applied using any applicator. However, best results are obtained when it is applied with a nonwoven nylon finishing pad having bonded thereto a mixture of phenolic resins and abrasives. The most effective abrasives are selected from silicon carbide, aluminum oxide and talc, or any combination of the same. Such finishing pads are made by Carborundum Abrasives Co. of Niagara Falls, New York and sold under the name "Carbo-Cut®."

The composition has low sudsing properties so as to work with the silicone carbide nonwoven pads to effectively reshape and smooth the rough crater surface of the stainless steel golf club heads.

EXAMPLE

An especially preferred form of the composition of the present invention was formulated by mixing deionized water and 0.5 wt % polysaccharide xanthan gum for two hours while gradually increasing the temperature of the mixture to 150° F. The temperature was then slowly reduced to room temperature while continuing the mixing process. After two to three hours of mixing, the composition was left to sit 8–12 hours. After such time, the following components were added in the amounts specified:

| | wt % |
|---|---|
| sodium metasilicate | 3.0 |
| sodium ethylene diaminetetraacetate, | 0.5 |
| lower alkyl ester of a linear primary alcohol containing 9–17 carbon atoms | 1.5 |
| sulfonated distyryl biphenyl | 0.05 |
| lower alkyl acid ester of p-hydroxybenzoic acid | 0.9 |
| dye | 0.002 |

After all components were added to the water/gum mixture, the composition was mixed again for one hour.

This composition was applied with a "CarboCut®" finishing pad to clean a variety of stains and dirt from the heads of several Taylor-Made® metalwood golf clubs having heads made of 17-4 stainless steel with a sandblast finish. The composition effectively cleaned a variety of stains from the clubs and provided them with a bright and new-looking surface.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A composition for cleaning me&al golf club heads consisting essentially of the following components in the indicated approximate weight percentages:

| | | wt % |
|---|---|---|
| (a) | polysaccharide xanthan gum | 0.25–5.0 |
| (b) | sodium metasilicate; | 0.25–5.0 |
| (c) | sodium ethylene diaminetetraacetate; | 0.25–5.0 |
| (d) | lower alkyl ester of a linear primary alcohol containing 9 to 17 carbon atoms | 0.25–5.0 |
| (e) | sulfonated distyryl biphenyl; | 0.01–0.1 |
| (f) | lower alkyl acid ester of p-hydroxybenzoic acid; | 0.01–0.1 |
| (g) | dye; and | .001–.01 |
| | balance deionized water. | |

2. The composition of claim 1 wherein components (a) through (g) are present in the following approximate weight percentages: (a) 0.5; (b) 3.0; (c) 0.5; (d) 1.5; (e) 0.05; (f) 0.09; and (g) 0.002.

3. The composition of claim 1 wherein component (b) has a ratio of NazO to SiOz of 1:1.

4. The composition of claim 1 wherein the lower alkyl group of component (d) is ethyl.

5. The composition of claim 1 wherein the lower alkyl group of component (f) is selected from methyl and propyl.

6. A method for cleaning metal golf club heads comprising applying thereto an effective amount of a composition consisting essentially of the following components in the indicated approximate weight percentages:

| | | wt % |
|---|---|---|
| (a) | polysaccharide xanthan gum | 0.25–5.0 |
| (b) | sodium metasilicate; | 0.25–5.0 |
| (c) | sodium ethylene diaminetetraacetate; | 0.25–5.0 |
| (d) | lower alkyl ester of a linear primary alcohol containing 9 to 17 carbon atoms | 0.25–5.0 |
| (e) | sulfonated distyryl biphenyl; | 0.01–0.1 |
| (f) | lower alkyl acid ester of p-hydroxybenzoic acid; | 0.01–0.1 |
| (g) | dye; and | .001–.01 |
| | balance deionized water. | |

7. The method of claim 6 wherein components (a) through (g) are present in the following approximate weight percentages: (a) 0.5; (to 3.0; (c) 0.5; (d) 1.5; (e) 0.05; (f) 0.09; and (g) 0.002.

8. The method of claim 6 wherein said composition is applied with a pad comprising nonwoven nylon webbing with a composition of phenolic resins and abrasives adhered thereto.

9. The method of claim 8 wherein said abrasives are selected from the group consisting essentially of silicon carbide, aluminum oxide, talc and mixtures thereof.

* * * * *

UNITED STATES PATENT AND TRADEMARK OFFICE

CERTIFICATE OF CORRECTION

PATENT NO. : 5,064,556

DATED : November 12, 1991

INVENTOR(S) : Joseph F. Brandes et al.

It is certified that error appears in the above-identified patent and that said Letters Patent is hereby corrected as shown below:

Col. 1, Line 13: delete "," after task and replace with --(.)--, change "although" to --Although--

Col. 1, Line 22: delete "glass" change to --grass--

Col. 1, Line 32: delete "clearing" change to --cleaning--

Col. 1, approximate Line 57 in Table: (percentage of chemical weight for p-hydroxybenzoic acid; is misaligned) after ester of delete "0.01-0.1"; after acid; add --0.01-0.1--

Col. 2, Line 10: delete "p-hydroxybenzoic" and add --p-hydroxybenzoic" (underline p)

Col. 3, Line 1: delete "me&al" and add --metal--

Col. 3, Line 22: delete "NazO" and add --$Na_2O$--

Col. 3, Line 23: delete "SiOz" and add --$SiO_2$--

UNITED STATES PATENT AND TRADEMARK OFFICE

CERTIFICATE OF CORRECTION

PATENT NO. : 5,064,556

DATED : November 12, 1991

INVENTOR(S) : Joseph F. Brandes et al.

It is certified that error appears in the above-identified patent and that said Letters Patent is hereby corrected as shown below:

Col. 4, Line 20: after (a) 0.5; delete "(to 3.0;" and add --(b) 3.0;--

Signed and Sealed this

Thirty-first Day of August, 1993

Bruce Lehman

*Attest:*

BRUCE LEHMAN

*Attesting Officer*

*Commissioner of Patents and Trademarks*